US005806360A

United States Patent [19]

Dumas

[11] Patent Number: 5,806,360

[45] Date of Patent: Sep. 15, 1998

[54] ROLLING MILL INSTALLATION

[75] Inventor: Bernard Dumas, Moingt-Montbrison, France

[73] Assignee: CLECIM, Cergy Pontoise Cedex, France

[21] Appl. No.: 540,109

[22] Filed: Oct. 6, 1995

[30] Foreign Application Priority Data

Oct. 6, 1994 [FR] France ..... 94 11963

[51] Int. Cl.[6] ..... B21B 29/00

[52] U.S. Cl. ..... 72/241.8; 72/238; 72/244

[58] Field of Search ..... 72/241.2, 241.8, 72/244, 245, 247, 238

[56] References Cited

U.S. PATENT DOCUMENTS

| | | | |
|---|---|---|---|
| 4,691,548 | 9/1987 | Richter et al. | 72/241.8 |
| 4,803,865 | 2/1989 | Jansen et al. | 72/247 |
| 5,090,228 | 2/1992 | Schmiedberg et al. | 72/238 |
| 5,253,503 | 10/1993 | Barten et al. | 72/241.8 |
| 5,291,770 | 3/1994 | Koujin et al. | 72/244 |
| 5,638,716 | 6/1997 | Jonen | 72/241.8 |

FOREIGN PATENT DOCUMENTS

| | | |
|---|---|---|
| 1 314 027 | 11/1962 | France . |
| 2 661 625 | 11/1991 | France . |
| 3807 654 | 9/1989 | Germany . |

OTHER PUBLICATIONS

Abstracts of Japan, vol. 14, No. 351, Jul. 30, 1990.
Abstracts of Japan, vol. 5, No. 190, Dec. 4, 1981.
Search Report FR 94 11963 Jun. 1995.
Soviet Inventions Illustrated, Section Ch, Week D25 Issued Jul. 29, 1981.
Abstracts of Japan vol. 18, No. 550, Oct. 20, 1994.
Abstracts of Japan, vol. 10, No. 320, Oct. 30, 1986.

*Primary Examiner*—Joseph J. Hail, III
*Assistant Examiner*—Ed Tolan
*Attorney, Agent, or Firm*—Law Offices Pollock, Vande Sande & Priddy

[57] ABSTRACT

A rolling mill comprising at least two work rolls supported by chocks (4, 40) mounted so as to slide, with clearance, between two fixed guide faces (13*a*, 13*b*). Each chock (4, 40) is thrust laterally against the guide faces (13*a*, 13*b*) in order to take up the clearance when in service. Each chock (4, 40) is surrounded by two intermediate pieces (6*a*, 6*b*) mounted so as to slide without clearance along the corresponding guide faces (13*a*, 13*b*). These intermediate pieces are rigidly locked vertically with the chock (4) so as to move with it. Lateral thrustors (7) are interposed between at least one side of each chock (4) and the facing intermediate piece (6*b*) in order to push the chock back against the other intermediate piece (6*a*) and corresponding guide face (13*a*). The two guide faces (13*a*, 13'*a*) against which the two chocks (4, 4') of a roll (2) are pressed define a reference plane (P1) for the positioning of the axis of the roll (2) with the possibility of sliding parallel to that plane (P1).

21 Claims, 6 Drawing Sheets

ROLLING MILL INSTALLATION

FIELD OF THE INVENTION

The present invention relates to an installation for rolling a flat product such as a ferrous or non-ferrous metal strip and can be applied to hot or cold rolling.

BACKGROUND OF THE INVENTION

A rolling mill comprises, in a general way, a set of superposed rolls located inside a fixed supporting stand having two spaced uprights in which openings or "windows" having two vertical parallel sides are provided.

Generally, the product to be rolled is passed, in a longitudinal direction, between two work rolls of relatively small diameter, the side of these work rolls furthest from the product each bearing on one or more pressure rolls of larger diameter. "4-high" type rolling mills comprise two work rolls each associated with a pressure roll. In "6-high" type rolling mills, intermediate rolls are interposed between each work roll and the associated pressure roll.

The axes of all the rolls are normally located within a given clamping plane substantially perpendicular to the longitudinal feed axis of the product and generally coinciding with a transverse median plane of the stand.

Each roll is supported by a shaft with two ends which are mounted so as to rotate, via bearings, on two chocks slid respectively into the two windows of the uprights of the stand.

The product is rolled by exerting a clamping force applied between the chocks of the pressure rolls and transmitted to the product by the work rolls. To effect clamping, each roll must therefore be able to move vertically in order to adapt to the thickness of the product and to variations in diameter resulting, for example, from wear.

Consequently, the chocks of each roll are generally provided with slide faces that cooperate with guide faces provided on the two sides of each window.

Since the work rolls are smaller in diameter, the guide faces and their chocks can be closer together and are generally provided on protruding parts provided in the central part of each window.

It must also be possible to change the rolls in the event of wear or damage, or when rolls of a different diameter are required. For this purpose, the rolls may be brought onto the stand or removed from it by sliding, parallel to their axes, along rails fixed on the uprights of the stand and on which the chocks rest for example by means of rollers. It is also possible to replace both work rolls at the same time, the chocks of the upper roll resting on the chocks of the lower roll which themselves travel along the fixed rails. The chocks of the rolls must therefore slide not only vertically, but also horizontally between the guide faces provided on the two sides of the window.

To allow the chocks to effect their various sliding movements and the rolls to be installed or removed from the stand, a small clearance must be left between the lateral faces of the chock and the corresponding guide faces.

As a result, the positioning accuracy of the axes of the different rolls and particularly their parallelism cannot be rigorously assured.

Furthermore, during rolling, the work rolls bear, on one side, on the product being fed through, and on the other on a pressure roll or intermediate roll, and as a result any misalignment, however small, of the axis of a work roll with respect to the feed direction of the product and the axis of the corresponding pressure roller, can lead to axial displacement of the roll which is pushed towards one of the uprights of the stand, the associated pressure roll being, generally, subjected to axial displacement in the opposite direction. While the rolls are retained by axial end stops, rubbing with a hysteresis effect can occur and can upset the thickness control normally performed by the clamping system.

Furthermore, since the clamping forces are applied on the ends of the shafts of the pressure rolls, the latter rolls can deform slightly by bending, particularly since the width of the product may vary and does not therefore extend, normally, across the entire length of the work rolls. As a result, the ends of the work rolls tend to move closer together and the compression force is no longer equally distributed across the entire width of the product, the lateral edges being crushed more than the central part.

This effect can be compensated for by giving the pressure rolls a bowed, possibly variable profile.

However, it is also possible to exert adjustable cambering forces on the ends of the work roll shafts in order to correct the profile of the work rolls to compensate for the bending of the pressure rolls.

For this purpose, use is most often made of jacks which bear on the chocks so as to move them apart and bring about what is known as "positive" cambering of the work rolls.

Use is also often made of jacks acting in the opposite direction, which bear directly on the stand or on the chocks of the associated pressure roll, in order to move the two chocks of the work rolls closer together and bring about what is known as "negative" cambering.

In some arrangements, cambering is performed in both directions by double-action jacks.

To take up the lateral clearances and assure the positioning of the axes of the work rolls, it has been proposed to associate each chock with lateral thrust means made up of jacks or deformable faces arranged on the two sides of the chock and bearing horizontally on the stand, each chock being thus rigidly locked with the corresponding upright by lateral thrusting against the two sides of the window (DE-A-3.807.654).

In a similar arrangement adapted to reversible rolling, it was proposed to increase the clearance between the chocks of the work rolls and their guide faces so as to cause, by means of lateral pressure jacks, displacement of the line of the axes of work rolls on one side or the other of the line of the axes of the pressure rolls, according to the rolling direction (FR-A-1.314.027).

In all cases, the chocks are rigidly locked, in service, to the uprights of the stand, by lateral pressing against the two sides of the window. As a result, if it is desired to camber the rolls in order to compensate for bending, this effect must be adjusted in advance since the spacing of the chocks cannot be adjusted during rolling.

In a particular embodiment disclosed in document JP-A-61-129208, it was proposed to increase the lateral tightening of the chocks in the event that they move apart during rolling.

For this purpose, each chock is provided with cambering jacks and lateral jacks in which the chambers are linked to each other in such a way that any increase in pressure in the direction corresponding to the moving apart of the chocks causes an increase in the lateral thrust force thereby locking the chock.

Over the last few years, it has appeared very advantageous to use cambering jacks not only to compensate for the bending of pressure rolls, but also to vary, during rolling, the profile of the air gap and the distribution of stresses in the transverse direction in order to correct flatness faults detected downstream.

SUMMARY OF THE INVENTION

To overcome these kinds of problems, an object of the invention is an arrangement which makes it possible to make all the adjustments necessary to perform rolling under optimal conditions, even while rolling is in progress, by immediately correcting all detected faults.

Indeed, the invention provides a means of vigorously checking the position and, in particular, the parallelism of the axes of the rolls, without stopping the application of cambering corrective forces on the axes in either direction.

The arrangements of the invention also make it possible to make all necessary corrections to the positioning of the chocks in order to minimize axial thrusts, compensate for the bending of rolls, and correct flatness faults.

Moreover, thanks to the large degree of adjustment flexibility provided by the invention, it is also possible to slightly offset the axes of the pressure rolls with respect to the clamping plane passing through the axes of the work rolls, or to set up a predetermined crossing of the axes of the different rolls in order to obtain special effects.

The invention therefore concerns, in a general way, an installation for rolling a flat product, comprising a supporting stand having two spaced uprights between which at least two superposed work rolls are placed. The work rolls respectively turn about axes located substantially in a clamping plane perpendicular to the product feed direction, and defining an air gap for the passage of the product, and a means for clamping rolls bearing on the fixed stand, each roll being supported by a shaft having two ends mounted so as to rotate, via bearings, respectively on two chocks slid into two windows provided respectively in the two uprights of the stand and mounted so as to slide along fixed guide faces, parallel to the clamping plane P and provided on the two sides of each window. Clearances are left on either side of each chock to allow the installation and removal of each roll with its chocks, each chock being associated with means for thrusting laterally against the guide faces in order to take up the clearances when in service.

According to the invention, each chock of a work roll is associated with two intermediate pieces interposed respectively between the two sides of the chock and the corresponding guide faces and on which means are mounted for cambering the work rolls. The means bear on the chocks at least in the positive direction of separation of the chocks. The intermediate pieces are held respectively pressed against the corresponding guide faces of the window, with the possibility of sliding without clearance, parallel to the clamping plane, and lateral thrust means are interposed between at least one of the intermediate pieces and the corresponding side of the chock so as to bear on the corresponding guide face in order to push the chock on the other side back against the other intermediate piece and the other guide face, this latter forming a permanent lateral holding face for the positioning of the axis of the roll with the possibility of the chock sliding with the two associated intermediate pieces parallel to said lateral holding face, when acted on by the cambering means.

In a particularly advantageous embodiment, adjustable thickness retaining means are interposed between at least the intermediate piece located on the opposite side to the lateral thrust means and the facing side of the chock. These retaining means define, on each window, a virtual lateral holding face for the chock, the position of which can be adjusted by varying the thickness of the retaining means.

The invention applies especially to a 4-high type rolling mill comprising two work rolls each associated with at least one pressure roll. In this case, each window of an upright is provided with two flat guide faces, each parallel to the clamping plane and extending over the entire height of the window, so as to embody the chocks of all the rolls, the chocks each being associated with two intermediate pieces fitted with holding means able to slide without clearance along the guide faces and on which lateral thrust means are mounted forming, on one side, a means for pressing, and on the other side, an adjustable means for retaining the corresponding chock.

Preferably, the two intermediate pieces located on either side of the chock are each associated with thrust means having an adjustable distance of travel, interposed respectively between the intermediate piece and the facing side of the chock, the portion of the thrust means located on the side of the guide face against which the chock is pressed being adjustable so as to define a virtual lateral holding face for the chock.

Due to such arrangements, the rolling mill can be provided with means for measuring the axial thrust exerted, in either directions by either of the ends of a roll on the corresponding upright of the stand, and the respective positions of the virtual faces for holding the two chocks are determined by adjusting the retaining means according to the axial thrust measurement, so as to determine an orientation of the axis of the roll that is able to compensate for the measured axial thrust.

As a result, it is possible to define virtual holding faces of the chocks whose positions can be adjusted in order to vary the position of the axis of a roll with respect to the others, for example to eliminate the measured axial force, or set up crossed axes, or offset the plane passing through the axes of the work rolls with respect to the plane passing through the axes of the pressure rolls.

BRIEF DESCRIPTION OF THE DRAWINGS

The invention will be better understood from the following description of a number of embodiments of the invention given by way of example and shown in the attached drawings.

DESCRIPTION OF PREFERRED EMBODIMENT

Figure 1:
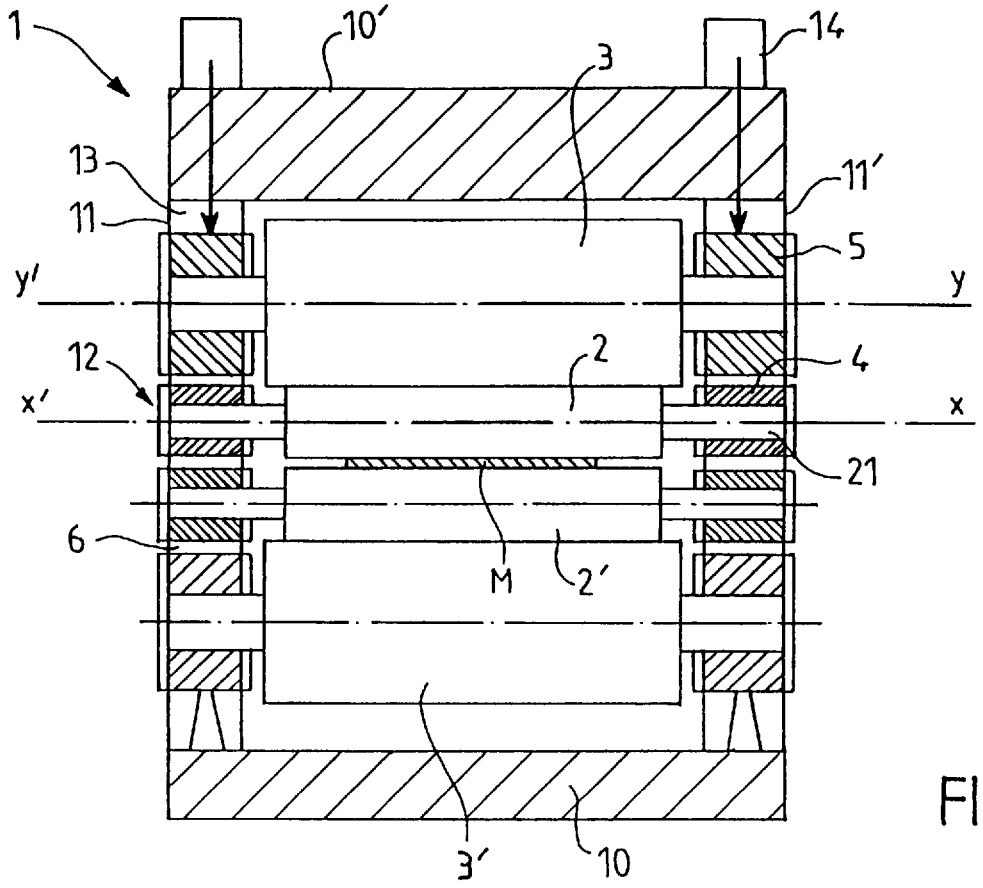
FIG. 1 is a schematic front view in elevation of a 4-high type rolling mill.
Figure 2:
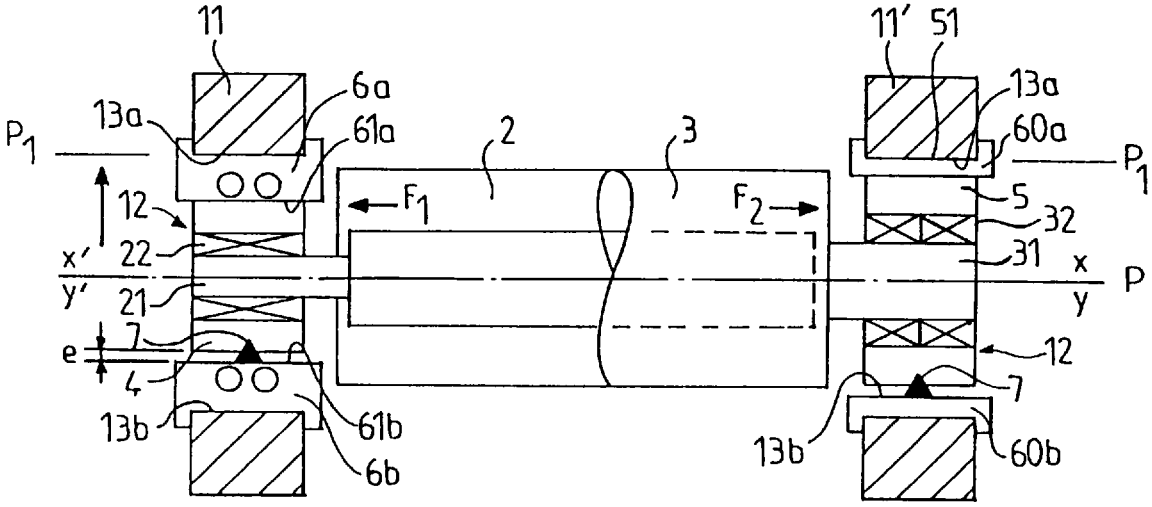
FIG. 2 is a schematic top plan view of the rolling mill, with a partial through-view.

As shown in FIGS. 1 and 2, a rolling mill stand 1 comprises two spaced vertical uprights 11, 11', fixed on a beam 10 or, alternatively, directly on a foundation block, and linked by a cross piece 10'.

In the example shown, the rolling mill is a 4-high type and comprises two work rolls 2, 2', defining an air gap through which the product M to be rolled passes, the side furthest from the product M of each said work roll bearing, respectively, on a pressure roll 3, 3'.

Each work roll 2 is mounted for rotation on a central shaft having two ends 21 turning respectively in aligned bearings 22 defining the axis of rotation x–x' of the roll.

Bearings 22 are mounted, respectively, in supporting chocks 4 which are inserted into windows 12 provided respectively in the two uprights 11 of stand 1.

In the same way, each pressure roll 3 is mounted for rotation about its axis y–y' on a shaft whose ends turn in bearings 32 mounted in chocks 5 slid into windows 12, the axes of all the rolls being located substantially in the same clamping plane P forming a median plane of the stand.

The rolling force is exerted by clamping means 14 such as screws or jacks, mounted on stand 1 and bearing on chocks 5 of one of the pressure rolls 3.

To allow the rolls to be clamped, the chocks must be mounted for sliding movement along guide faces parallel to plane P.

As mentioned above, the guide faces of the work roll chocks are normally provided on protruding parts, the rolls being smaller in diameter.

Each window 12 of the stand is defined by two flat faces 13*a*, 13*b* which extend over the entire height of the window so as to each form a common guide face for the chocks of all the rolls.

As shown, respectively on the left and right of FIG. 2, the chocks 4 of the work rolls and, preferably, the chocks 5 of the pressure rolls are each located between two intermediate pieces 6*a*, 6*b*, respectively 60*a*, 60*b*, which are pressed and held against guide faces 13*a*, 13*b* of window 12 with the possibility of sliding without clearance.

To allow rolls to be installed and removed, a certain clearance is left between lateral faces 41, 51 of the chocks of work roll 4 and pressure roll 5, and, respectively, the facing lateral faces of intermediate pieces 6, 60.

As shown schematically in FIG. 2, this clearance can be eliminated by thrust means 7 interposed between at least one of the intermediate pieces 6*b* and the facing face of chock 4 in order to push back the chock towards the opposite guide face 13*a* which therefore forms a permanent lateral holding face for corresponding roll 2.

The two lateral faces 13*a*, 13'*a* located on the same side of plane P on windows 12, 12' thus define a reference plane P1 for the positioning of the x–x' and y–y' axes of work rolls 2, 2' and pressure rolls 3, 3'.

Furthermore, according to another essential embodiment of the invention, the sliding assembly of intermediate parts 6*a*, 6*b* for guiding chocks 4 of work rolls 2 can have cambering jacks 81 of the rolls 2 placed on them, these jacks being associated with oil supply means, and the assembly forming a hydraulic cambering block which, in contrast to conventional arrangements, therefore moves with the chock along guide faces 13*a*, 13*b*.

To allow intermediate pieces 6 to slide without clearance along guide faces 13, roller or slider systems can be used, these being described in greater detail below with reference to FIGS. 5 to 9.

In addition, it is particularly advantageous to interpose adjustable thickness retaining means between each chock 4 and the intermediate piece 6*a* against which it is pressed. For this purpose, in the embodiment shown schematically in FIG. 3, hydraulic jacks 70*a*, 70*b* are located, respectively, on either side of each chock 4, their pressure and position being adjustable.

Jacks 70*b*, interposed between each chock 4 and intermediate piece 6*b*, bear on intermediate piece 6*b* and the corresponding side 13*b* of the window so as to push chock 4 back towards the opposite side 13*a*, and thus form the means for pressing each chock 4 against guide face 13*a* of upright 11.

However, the pressure exerted by jacks 70*b* is adjusted so as to be simply sufficient to eliminate the clearances, and also limited so as to avoid the chock clamping against the uprights of the stand, therefore allowing intermediate pieces 6*a*, 6*b* to slide when acted on by cambering means 8.

On the other side of the chock, the position of jacks 70 bearing on intermediate piece 6*a* can be adjusted so as to form an adjustable thickness retaining means making it possible to adjust the distance between lateral side 41 of chock 4 and guide face 13*a*.

As a result, the ends of the two jacks 70*a* facing chock 4 define a virtual holding face of the chock whose position can be adjusted by varying the distance of travel of jacks 70*a*.

Figure 3:
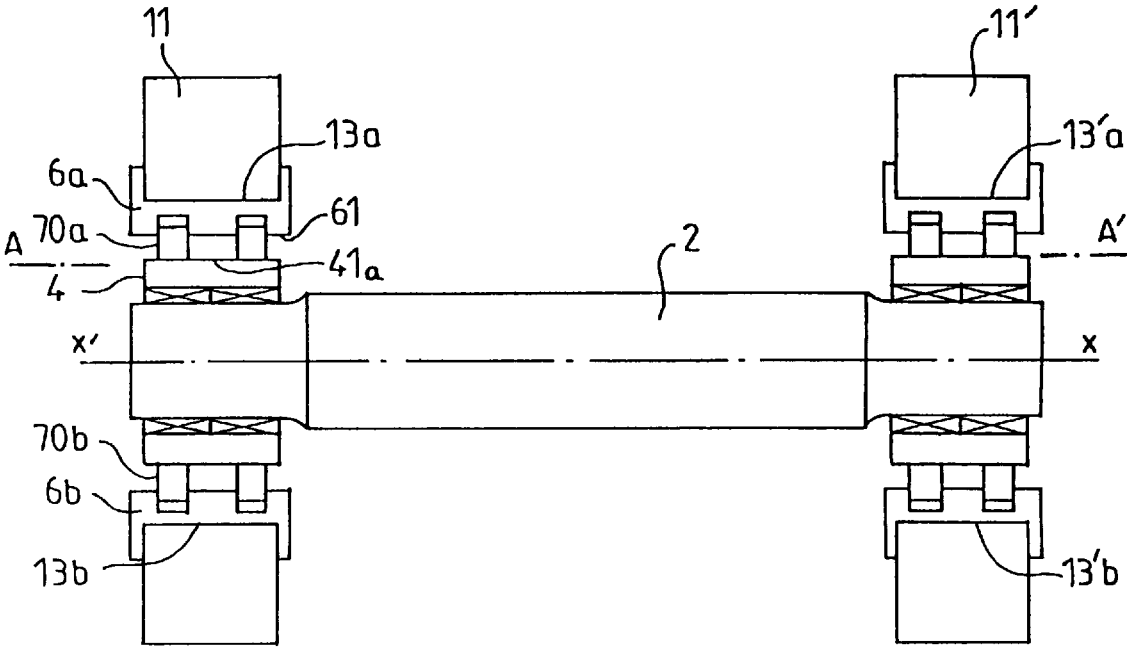
FIG. 3 is a schematic top plan view of a work roll provided with alignment adjustment means.

Thus, while, in the case of FIG. 2, each roll can be pressed against a reference plane P1 defined by two fixed guide faces 13*a*, 13'*a*, in the case of FIG. 3 it is possible to vary, with respect to one another, the positions of virtual holding faces A, A' with respect to guide faces 13*a*, 13'*a* of the two uprights 11, 11', and consequently to give the x–x' axis of roll 2 a predetermined direction which, if necessary, can be slightly offset angularly with respect to plane P2 passing through guide faces 13*a*, 13'*a* of the two uprights 11, 11'.

Due to such arrangements, it is therefore possible, on the one hand, to position the axis of each roll with respect to a fixed reference plane, or to vary the orientation of the reference plane according to needs and, on the other hand, to permanently exert positive or negative cambering forces on the rolls, it being possible to perform these two types of adjustment simultaneously and while rolling is in progress.

Figure 4:
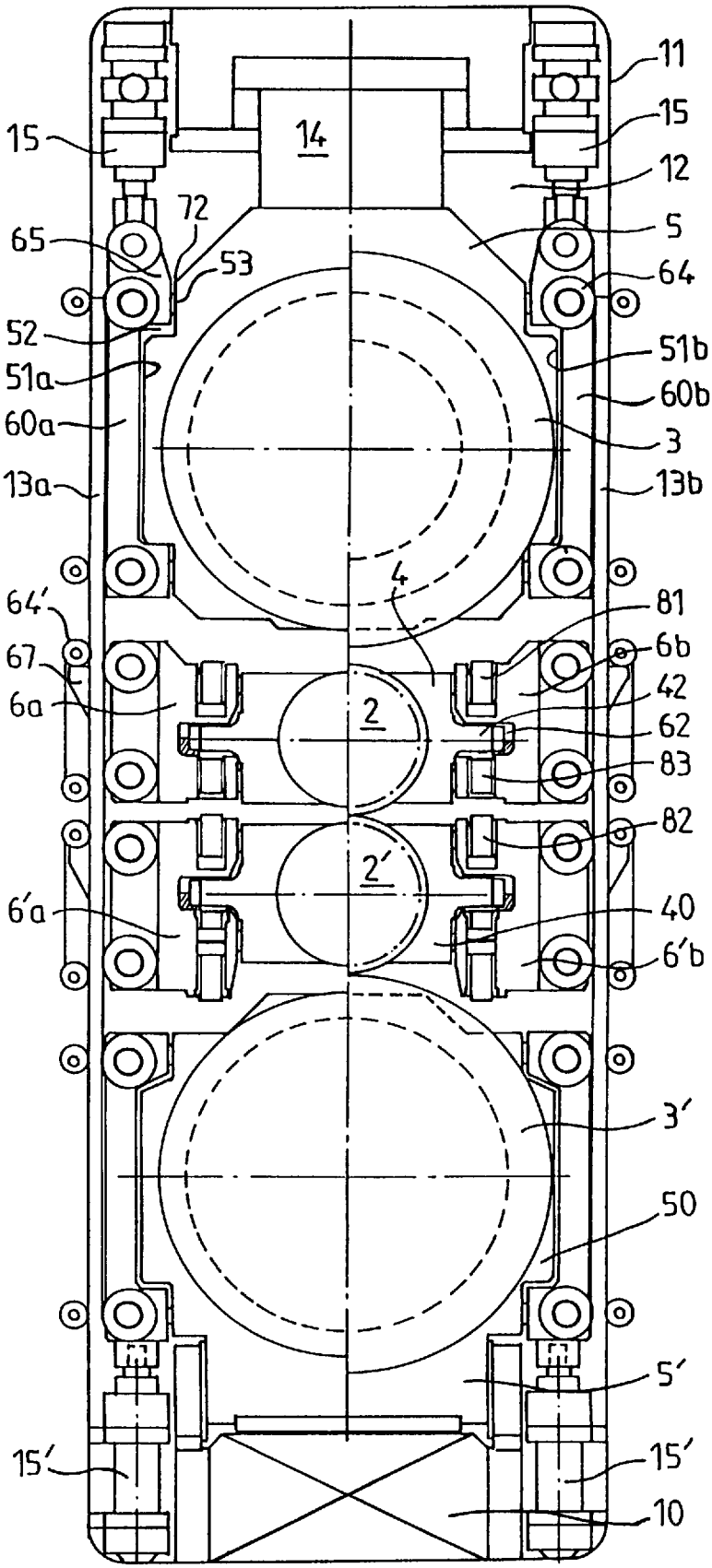
FIG. 4 is a front elevation view of rolling mill according to the invention.

FIG. 4 shows, in elevation, an example of a rolling mill improved according to the invention in the work roll replacement position.

The rolling mill is a "4-high" type and therefore comprises two work rolls 2, 2', associated with two pressure rolls 3, 3', the axes of which are located substantially in a vertical clamping plane P which forms a transverse median plane of stand 1 of the rolling mill, the stand comprising two uprights 11, 11', provided with windows 12, 12' into which the chocks of the different rolls are slid.

The rolls are clamped by a screw or jack system 14 which, in the example shown, bears on chocks 5 of upper pressure roll 3, while chocks 5' of the lower pressure roll bear directly on beam 10.

Each chock 4 of a work roll 2 is located between two intermediate pieces 6*a*, 6*b*, and is provided with two lugs 42 on which means bear to effect positive or negative cambering of the roll. As is normally the case, these cambering means consist of small jacks housed with their supply and return lines in intermediate pieces 6*a*, 6*b*, each therefore forming a hydraulic cambering block.

Figure 5:
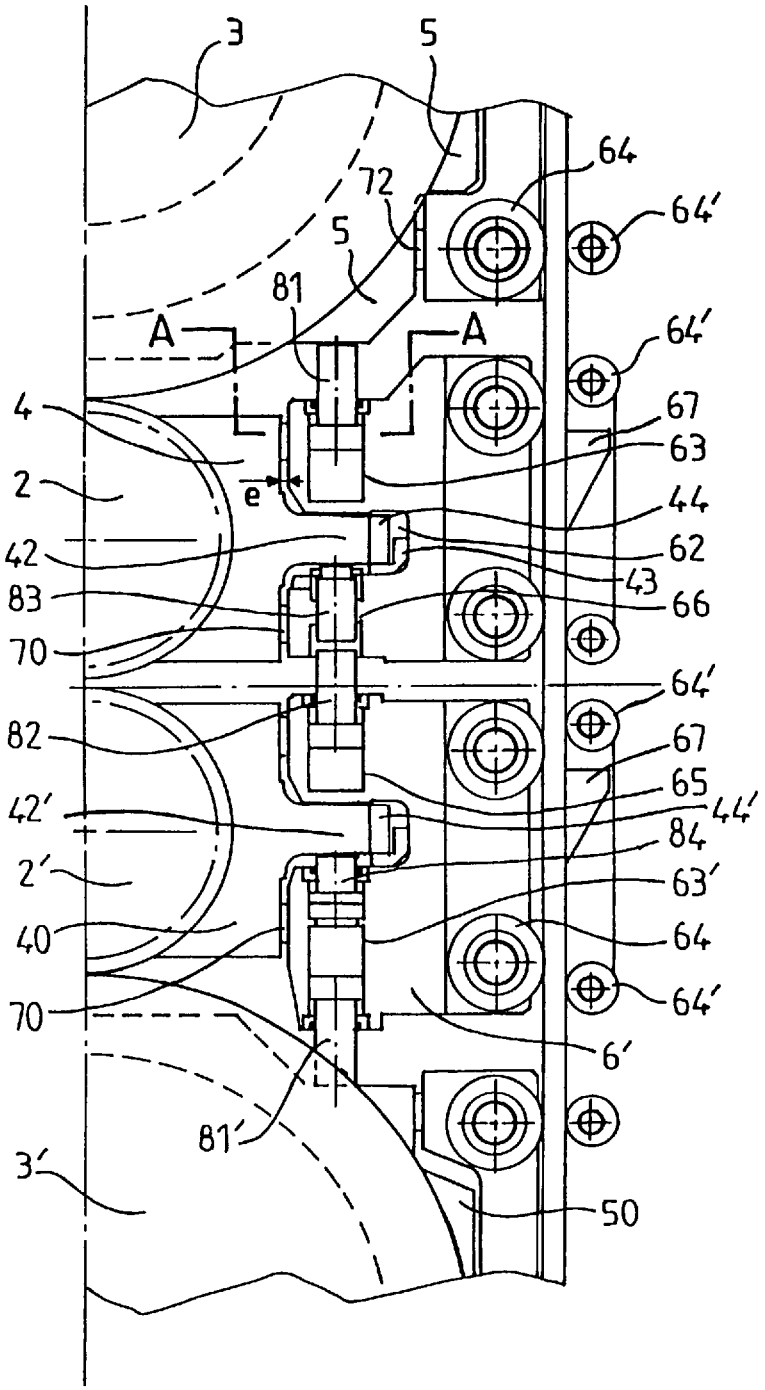
FIG. 5 is a detail view showing, in elevation, the chocks of two superposed work rolls.

In the embodiment shown in FIGS. 4 and 5, each chock 4 is provided with two lugs 42 which engage, with clearance, in notches 62 provided respectively in the central part of each intermediate piece 6*a*, 6*b*.

Each intermediate piece 6 is provided with two pairs of horizontal axis jacks 70 on its lateral face facing the chock, these jacks being located respectively above and below notch 62 and bearing on the corresponding lateral face 41 of chock 4.

Jacks 70, located on either side of the chock, act in opposite directions and can therefore be single acting. The supply lines (not shown in FIGS. 4 and 5), are provided inside the intermediate pieces 6, which thus form movable hydraulic blocks.

As already mentioned, the horizontal thrust exerted by jacks 70 ensures the rigid locking of each chock 4 with intermediate pieces 6*a*, 6*b* that surround it, these intermediate pieces therefore moving vertically with the chock by sliding without clearance along guide faces 13*a*, 13*b* of window 12.

For this purpose, each side of each intermediate piece 6 is provided with two pairs of rollers 64 mounted for rotation about axes parallel to the axis of the roll and able to roll on guide faces 13*a*, 13*b* provided along the two lateral sides of window 12 and parallel to clamping plane P. Each intermediate piece 6 can be held pressed against upright 11, for example by hooks sliding in grooves. However, it is also possible to mount auxiliary rollers 64' on each chock, these rollers being associated, respectively, with bearing rollers 64 so as to surround protruding parts 16 provided on both sides of each guide face 13*a*, 13*b*.

The clearance (e) remaining between the lateral sides 41 of each chock and the facing faces 61 of each piece 6 can be relatively large, so as to allow any required orientation of axis x–x' of the roll to be adjusted with respect to the guide faces 13.

At the time of roll installation and removal, the chocks remain fitted to the journals and move with the roll, whereas intermediate pieces 6*a*, 6*b* are held pressed against the guide faces 13 of the stand by the pairs of rollers 64, 64'.

Given that, at the time of cambering, intermediate pieces 6*a*, 6*b* move vertically with chock 4, notches 62 need simply be just a little larger than lugs 42 of the chocks, so as to simply provide the clearance necessary for lugs 42 to engage in notches 62 when the roll and its chocks are installed in position inside the stand.

The cambering jacks are housed in bores provided in the intermediate pieces associated with each working roll chock (4, 40). The negative cambering jacks (81, 81') which bear, in a conventional way, on chocks 5, 50, of the corresponding pressure rolls 3, 3', are thus housed in bores 63, 63', provided on the outwardly facing side of each working roll chock, respectively upper chock 4 and lower chock 40, facing the corresponding pressure roll chock 5, 50.

Positive cambering is performed, in a known way, by jacks 82 interposed between the two working roll chocks 4, 40. In the embodiment shown in FIGS. 4 and 5 by way of example, positive cambering jacks 82 are housed in bores 65 provided on the inwardly facing side facing upper chock 4 of each intermediate piece 6' associated with lower work roll chock 40. The rod of each jack 82 bears on a push rod 83 which is mounted for vertical sliding movement in a bore 66 passing through the lower part of intermediate piece 6 of upper chock 4 and which comes to bear against the corresponding lug 42 so as to press it against the upper side of notch 62 under the action of jack 82, intermediate piece 6 being held by negative cambering jacks 81 which bear against chock 5 of upper pressure roll 3.

In the lower part, included between notch 62' and the outwardly facing side of each intermediate piece 6' associated with lower chock 40, a push rod 84 is slidably mounted in the form of a jack that is coaxial with and opposite to negative cambering jack 81', the chambers of the two jacks 84, 81' communicating with each other. As a result, the pressure applied on jack 81' for negative cambering causes push rod 84 to rise and press lug 42' against the upper side of notch 62', thereby taking up the clearance.

The two push rods 83, 84 for eliminating clearance are thus actuated by the positive and negative cambering jacks 82; 81, 81'.

In the service position shown in FIG. 5, the positive and negative cambering jacks, are placed under pressure and push back push rods 83, 84, which press each lug 42, 42' against the upper face of the corresponding notch 62, 62'.

As a result, all the clearances are taken up, each chock 4, 40 being rigidly locked with the corresponding hydraulic blocks 6, 6'.

It should be noted that the positive and negative cambering jacks, as well as the push rods 83, 84 located on each side of the chock, are aligned, respectively, in two directions parallel to and equidistant from plane P. Moreover, all the jacks are fed at the same time and therefore act in opposite directions and mutually balance.

It is thus possible to perform positive or negative cambering by simply adjusting the relative pressures applied on the positive or negative cambering jacks so as to move the chock upwardly or downwardly by simple adjustment of the pressure difference in one direction or the other.

Due to this arrangement and to the sliding hydraulic block assembly formed by intermediate pieces 6, 6', the positive or negative cambering forces are enclosed on the stand and pass via pressure roll chocks 5, 5', jacks 14 and beam 10.

When work rolls are installed, cambering jacks 81, 81', 82 and, consequently, push rods 83, 84 are retracted so as to allow lugs 42 to slide freely into notches 62, as shown in FIG. 4.

Preferably, rail sections 43 are placed inside notches 62, these rail sections extending between the two uprights of the stand and moving with intermediate pieces 6, 6'.

When push rods 83, 84 are lowered, chocks 4, 40 come to rest on rails 43, 43' via rollers 44, 44' mounted for rotation on the ends of lugs 42, 42'.

Figure 6:
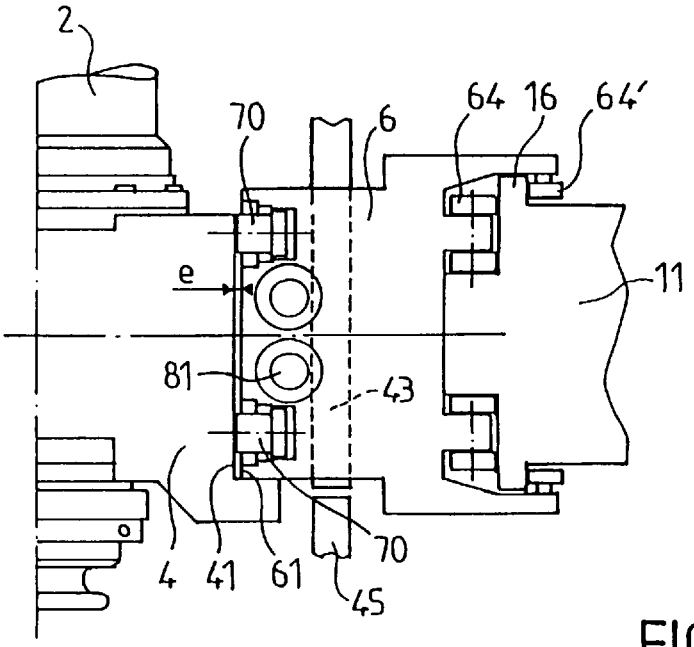
FIG. 6 is a top plan view, partly in section, along line A—A of FIG. 5.

In the work roll removal position, rollers 64' associated with each intermediate piece 6*a*, 6*b* come to rest on the fixed blocks 67 at a level for which the rail sections 43, 43' are located in the extension of fixed rails 45, shown schematically in FIG. 6.

In this position, it is therefore possible to proceed with the installation or removal of work rolls 2, 2' whose chocks 4, 4' are supported by rollers 44, 44' rolling on movable rails 43, 43' aligned respectively with the fixed rails.

The pressure rolls can be removed in a similar way, the corresponding intermediate pieces 60*a*, 60*b* being supported by jacks 15, 15'.

In the usual case in which cambering is performed, for each chock, by two pairs of jacks arranged respectively on either side of the chock, pairs of push rods 83, 84 will also be used, one push rod being associated with each jack.

Chocks 5, 50 of pressure rolls 3, 3' can be mounted in a conventional way in windows 12, 12' of the stand. In this case, the invention applies only to work rolls 2, 2'. Given that the position of horizontal thrust jacks 70 is adjustable, it is possible, as already seen, to adjust the positions of the virtual holding faces in order to compensate for axial thrust resulting from any possible angular offset of each work roll with respect to its pressure roll.

It is, however, particularly advantageous to apply the invention to pressure rolls 3, 3'.

In this case, as shown in FIG. 4, each chock 5, 50 of a pressure roll 3, 3' is associated with two intermediate pieces 60*a*, 60*b*, interposed between lateral faces 5l*a*, 51*b* of chock 5 and guide faces 13*a*, 13*b* of upright 11, the guide faces extending over substantially the entire height of window 12.

Stand 1 is also provided with two pairs of jacks 15, 15' which are used to adjust the height of pressure rolls 3, 3' by keeping both pairs of chocks 5, 50 pressed, respectively, against clamping system 14 and beam 10.

In the example shown, chocks 5, 50 of the two pressure rolls 3, 3' are each associated with two intermediate pieces 60*a*, 60*b* similar to intermediate pieces 6*a*, 6*b* of work roll chocks 4, and on which the rods of holding jacks 15, 15' are articulated.

In addition, the two intermediate pieces 60*a*, 60*b* surrounding each chock 5, 50, are each provided with two protruding parts 65 defining a cavity in which a lug 52 of chock 5 engages with clearance to allow the height of the rolls to be adjusted by jacks 15, 15'.

Horizontal thrust jacks 72 are also housed in protruding parts 65 and bear on lateral faces 53 of chock 5, on either side of lug 52, so as to press chock 5 against one of the guide faces 13*a* by bearing on the other face 13*b*, via pieces 60*a*, 60*b*.

The position of jacks 72 is adjustable, and this allows them to define a virtual holding face serving as a reference for the positioning of the axis y–y' of pressure roll 3 with the possibility of sliding.

Flexible and accurate means are thus available to keep the axis of each roll aligned with respect to the reference plane and to adjust the position of the rolls with respect to each other when necessary.

This positioning can, in particular, be adjusted according to the axial force detected at the end of a roll. For example, if a work roll is detected as exerting an axial force on one side of the stand, the positioning jacks of the roll chock located on the same side are adjusted so as to move the axis in the opposite direction to rolling, and then the corresponding pressure roll is acted on in the opposite direction so as to compensate for the axial force detected, the direction of action on the other side of the stand being reversed for each of the two rolls.

However, it is also possible to act on the chocks differently, for example in order to move the clamping plane passing through the axes of the work rolls with respect to the plane passing through the axes of the pressure rolls, to adjust the alignment of one work roll-pressure roll assembly with respect to the other, or to cross the clamping planes of the two assemblies.

It can therefore be seen that the invention has multiple possibilities and is not limited to the details of the embodiment described by way of example.

Figure 7:
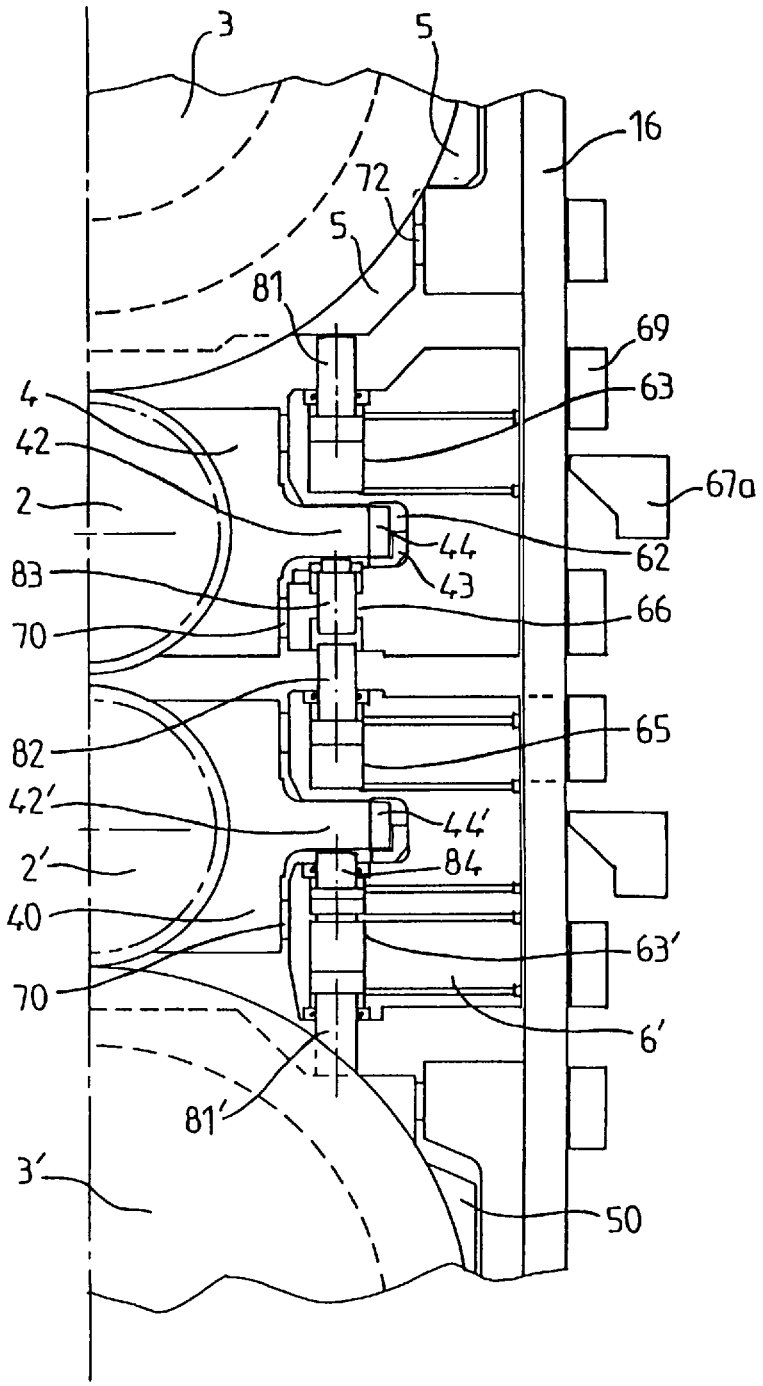
FIG. 7 is a partial view, in elevation, of another embodiment.
Figure 8:
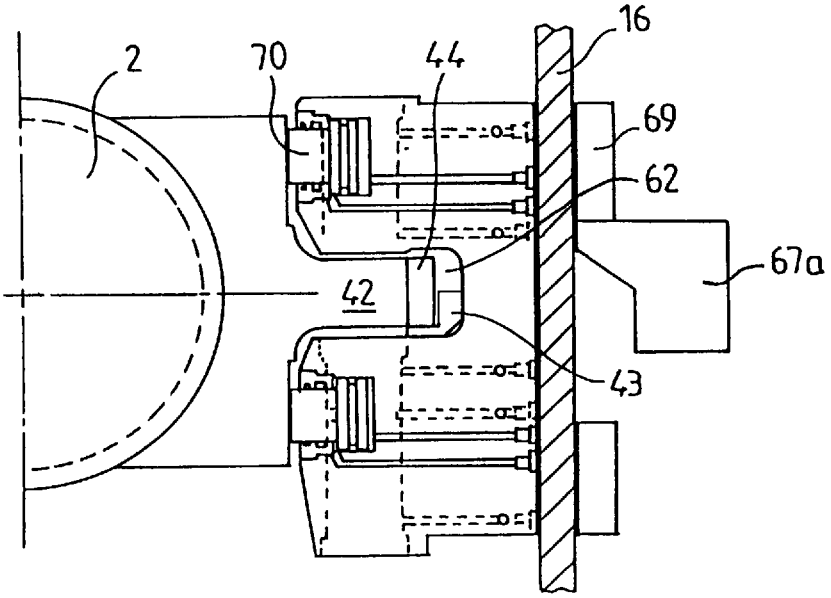
FIGS. 8 and 9 are, respectively, a side view and a top plan view of the embodiment shown in FIG. 7.
Figure 9:
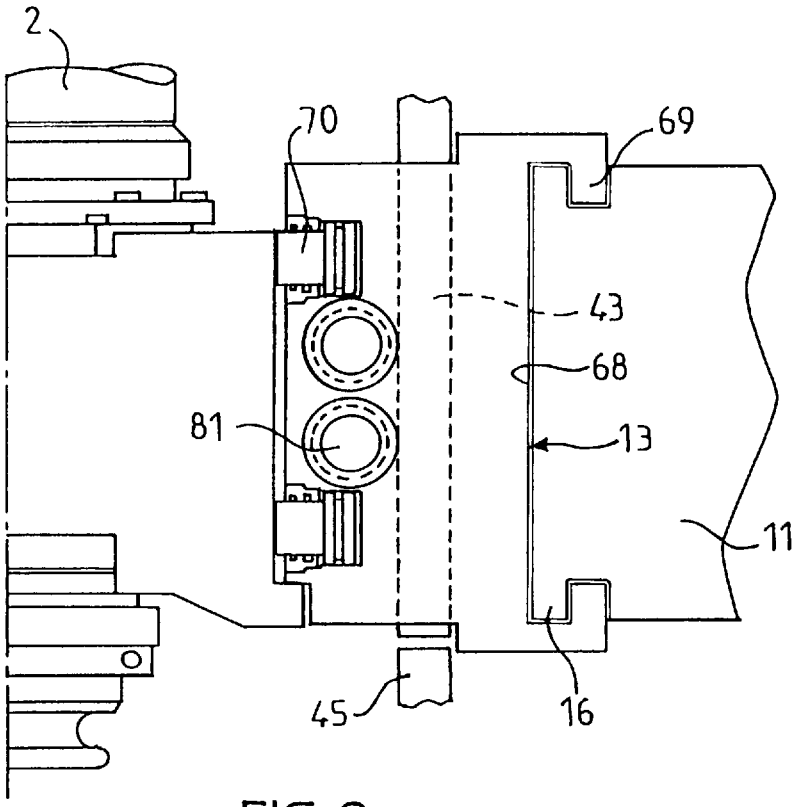

In particular, the roller bearing parts of the intermediate pieces could be replaced by simple smooth sliding bearings, in the way shown in FIGS. 7, 8 and 9.

As can be seen in FIGS. 8 and 9, each intermediate piece 6 comprises a face 68 designed to slide along the lateral face 13 of upright 11, with lubricating means (not shown) ensuring smooth sliding.

Lateral hooks 69 surround protruding parts 16 provided on either side of guide face 13 in order to hold intermediate piece 6 against that guide face 13.

As previously, in the roll removal position, hooks 69 rest on the fixed blocks 67*a* shown schematically in FIG. 8.

Other arrangements could also be employed for the positive or negative cambering of the rolls. For example, the bearing lugs provided on either side of each chock could, in a known way, extend above or below the hydraulic block.

Indeed, the invention only calls for the making of relatively minor modifications to the stand and can therefore be easily adapted to any existing type of rolling mill. In particular, the arrangements described by way of example in the case of a 4-high rolling mill can be used in a 6-high rolling mill comprising intermediate rolls interposed between each work roll and the pressure roll, or even in the case where each work roll presses against a set of rolls arranged either side of the median plane.

I claim:

1. A rolling mill for rolling a flat produce (M) along a longitudinal feed direction, said rolling mill comprising:

(a) a fixed supporting stand (1) including two spaced uprights (11, 11'), each having two sides;

(b) at least two superposed work rolls (2, 2') turning respectively about axes located substantially in a clamping plane (P) perpendicular to the feed direction of the product (M) and defining an air gap for the passage of said product (M);

(c) means (14) bearing on the fixed stand (1) for clamping said rolls (2) along said clamping plane (P);

(d) each roll (2, 2') being supported by a shaft having two ends mounted for rotation, via bearings, respectively on two chocks (4, 40) which are respectively inserted into two windows (12) provided respectively in said two uprights (11, 11') of said stand, each chock (4, 40) having a first side (41*a*) and a second side (41*b*);

(e) a first guide face (13*a*) and a second guide face (13*b*), parallel to the clamping plane (P) and respectively provided on two sides of each window (12);

(f) each chock (4) being associated with a first intermediate piece (6*a*) and a second intermediate piece (6*b*), interposed between each side of the chock (4) and, respectively, said first and second guide faces (13*a*, 13*b*) of the window (12), said intermediate pieces (6*a*, 6*b*) being slidably mounted, respectively, along said first and second guide faces (13*a*, 13*b*) and clearances being left between either side of each chock (4, 40) and a corresponding intermediate piece (6*a*, 6*b*) to allow installation and removal of each roll (2, 2') with its chocks (4, 40) of said roll;

(g) cambering means (8) mounted on said first and second pieces and bearing on the chocks (4, 40) of said work rolls for cambering them at least in a positive direction of separation of said chocks (4, 40), said intermediate pieces (6*a*, 6*b*) moving vertically with said chock (4, 40) under the effect of said cambering means (8);

(h) lateral thrust means (7) associated with each chock (4, 40) for taking up said clearances when in service, said lateral thrust means (7) being interposed between at least the second intermediate piece (6*b*) and the corresponding side of the chock (4, 40), said second intermediate piece (6*b*) slidably bearing against the corresponding second guide face (13*b*) in order to push the chock on the other side against the first intermediate piece (6*a*) which slidably bears against the first guide face (13*a*) of the window;

(i) adjustable thickness retaining means (70*a*) interposed at least between the first intermediate piece (6*a*) and a facing first side (41*a*) of the chock (4), said retaining means (70*a*) defining, on each window (12), a virtual lateral holding face (AA) for the chock (4), the position of which can be adjusted by varying the thickness of said retaining means (70*a*); and (j) each chock (4, 40) of each roll (2, 2') sliding with the two associated intermediate pieces (6*a*, 6*b*) parallel to said virtual lateral holding face (AA) when acted on by said cambering means (8).

2. The rolling mill according to claim 1, wherein the retaining means consist of thrust means (70) having an adjustable distance of travel, acting in a direction perpendicular to the corresponding guide face (13) and bearing in one direction on the chock (4) and in the opposite direction on the corresponding intermediate piece (6).

3. The rolling mill according to claim 2, wherein the two intermediate pieces (6*a*, 6*b*) located on either side of the chock (4) are each associated with thrust means (70*a*, 70*b*) having an adjustable distance of travel, interposed respectively between said intermediate piece (6*a*, 6*b*) and the facing side (41*a*, 41*b*) of the chock (4), the position of the thrust means (70*a*) located on the side of the guide face (13*a*) against which the chock (4) is pressed being adjustable so as to define a virtual lateral holding face for the chock (4).

4. The rolling mill according to claim 1, wherein an axial force is exerted, in either direction, by one of the ends of a roll on the corresponding upright (11) of the stand (1), said rolling mill comprising means for measuring said axial force, and retaining means (70*a*) being adjusted according to the measurement of said axial force so as to determine an orientation of the axis (x'x) of the roll (2) that is able to compensate said axial force measured.

5. The rolling mill according to claim 1, comprising two work rolls (2, 2') each associated with at least one pressure roll (3, 3'), wherein each window (12) of an upright (11) is provided with two flat faces (13*a*, 13*b*), parallel to the clamping plane (P) and forming a common guide face for the chocks (4, 40) (5, 50) of all the rolls (2, 2') (3, 3'), said chocks each being associated with two intermediate pieces (6*a*, 6*b*) (60*a*, 60*b*) fitted with holding means (64) able to slide without clearance along said guide faces (13*a*, 13*b*) and on which lateral thrust means (70) are mounted forming, on one side, a means for pressing (70*b*) and, on the other side, an adjustable means (70*a*) for retaining the corresponding chock (4, 40) (5, 50).

6. The rolling mill according to claim 5, wherein the two guide faces (13*a*, 13'*a*) against which the two chocks (4, 4') (5, 5') of each roll (2, 3) are pressed are located on the same side of the clamping plane (P) and define a fixed reference plane (P1) for the positioning of the axis (x'x, y'y) of the roll (2, 3).

7. The rolling mill of claim 1, wherein each intermediate piece (6, 60) comprises at least two bearing rollers (64) rolling on the corresponding guide face (13), located on two levels spaced in height and mounted so as to rotate about axes parallel to the axis of the roll (2, 3), said bearing rollers (64) being associated with holding rollers (64') rolling on opposite sides of protruding parts (16) provided respectively on the two sides of each guide face (13).

8. The rolling mill according to claim 1, wherein each chock (4, 5) of a roll is provided on each of its sides respectively, with two lateral lugs (42, 52) engaging with clearance in notches (62, 53) provided, respectively, on the two intermediate pieces (6, 60) associated with the chock (4, 5) so as to allow the roll (2, 3) to be removed with said chocks (4, 5), the guide pieces (6, 60) remaining rigidly locked with the stand (1).

9. The rolling mill according to claim 8, wherein the two intermediate pieces (6*a*, 6*b*) surrounding each chock (4) of a work roll (2) are provided with releasable means for rigidly locking said intermediate piece with the corresponding lug (42) of the chock (4) by taking up clearance in one of said notches (62).

10. The rolling mill according to claim 9, comprising means for taking up said clearance, said means being push rods (83, 84) mounted so as to slide, respectively, in the intermediate pieces (6, 6') associated, respectively, with the chocks (4, 40) of the two work rolls (2, 2') and actuated, in service, by the cambering means (8) in a direction pressing the corresponding lug (42) of each chock against the opposite side of the corresponding notch (62).

11. The rolling mill according to claim 10, wherein the intermediate pieces (6, 6') associated respectively with the chocks (4, 40) of the two work rolls (2, 2') support negative cambering jacks (81) which bear, in one direction on the intermediate piece (6, 6') and in the other direction on the chocks (5, 50) of the corresponding pressure roll so as to cause the chocks (4, 40) of the two work rolls (2, 2') to move towards each other.

12. The rolling mill according to claim 11, wherein the sliding holding means of each intermediate piece (6, 60) comprise a slide (9) comprising at least one sliding bearing face (91) provided on a side of the intermediate piece (6, 60) facing the corresponding guide face (13) and associated with means for forming a lubricating film, said intermediate piece (6, 60) being provided with two pieces forming hooks (92) surrounding two protruding parts (16) provided respectively on the two sides of each guide face (13) for holding the intermediate piece (6, 60).

13. The rolling mill according to claim 11, comprising positive cambering means in the form of jacks (82) housed in the intermediate pieces (6') associated with the chocks (40) of a first work roll (2') and bearing, in a positive direction of separation of the chocks (4, 40), on a push rod (83) mounted so as to slide in the chock (4) facing the second work roll (2) and itself bearing on the corresponding lug (42), and the intermediate pieces (6'*a*, 6'*b*) associated with each chock (40) of the first work roll (2') are provided with push rods (84) actuated by negative cambering jacks (81') of said chock (40) and bearing on the lugs (42') of said chock to take up said clearance in the notch (62').

14. The rolling mill according to claim 13, wherein positive (82) and negative (81, 81') cambering jacks are simultaneously actuated, and that after clearance in the notches (62, 53) has been taken up, a positive or negative cambering effect is determined, in service, by adjusting differences in supply pressures between the positive cambering jacks (82) and the negative cambering jacks (81, 81'), the intermediate pieces (6, 6') associated with the chocks (4, 40) of the work rolls (2, 2') sliding freely and the intermediate pieces (60, 60') associated with the chocks (5, 50) of the pressure rolls (3, 3') bearing on the stand in such a way that cambering forces are enclosed on the stand.

15. The rolling mill according to claim 14, wherein the positive cambering jacks (82), the two push rods (83, 84) and the negative cambering jacks (81, 81') located on each side of the clamping plane (P) are aligned, respectively, along two axes that are symmetrical with respect to said clamping plane (P).

16. A method for rolling a flat product feeding in a longitudinal direction, in a rolling mill for rolling a flat product along a longitudinal feed direction, said rolling mill comprising at least two superposed work rolls supported by a shaft having ends mounted on chocks each associated with first and second intermediate pieces interposed between each side of said chocks and first and second guide faces, said method comprising the steps of:

(a) adjusting the thickness of retaining means (70*a*) associated with each chock (4, 40) to define a virtual lateral holding face (AA) for said chock (4, 40);

(b) pushing each chock (4, 40) of each work roll (2, 2') and the associated first intermediate piece (6*a*) toward the first guide face (13*a*);

(c) vertically locking each chock (4, 40) with its associated intermediate piece (6*a*, 6*b*); and (d) cambering the work rolls by means of cambering means (8), each chock (4, 40) moving vertically with its associated intermediate pieces (6*a*, 6*b*) which slidably bear along the corresponding faces (13*a*, 13*b*);

(e) the axis (x, x') of said roll (2, 2') sliding parallel to said virtual lateral holding face (AA).

17. The method according to claim 16, wherein said rolling mill comprises a fixed supporting stand (1) including two spaced uprights (11, 11') and wherein an axial force, is exerted, in one direction, by one of the ends of a roll on the corresponding upright (11) of the stand (1), said method comprising the steps of:

(a) measuring an axial force exerted by said roll (2) on a side of the stand (1);

adjusting retaining means (70) associated with the chocks of said roll (2) for positioning the axis of said roll (2) parallel to a virtual lateral holding face (AA) so as to compensate for the detected axial force.

18. The method according to claim 16, in a rolling mill comprising two work rolls (2, 2') each bearing on at least one pressure roll (3, 3'), wherein a measurement is taken of axial force exerted by each work roll on either of the uprights of the stand of the rolling mill, and wherein the relative positioning of the axes of each work roll (2) and of the corresponding pressure roll (3) is acted on in such a way as to compensate for any detected axial force.

19. The method according to claim 16, in a rolling mill comprising two work rolls (2, 2') each associated with at least one pressure roll (3, 3'), wherein the retaining means (70) of the chocks of at least one of the rolls are adjusted so as to determine a crossing of the axis of a work roll (2) with respect to the axis of the corresponding pressure roll (3).

20. The method according to claim 16, in a rolling mill comprising two work rolls (2, 2') each associated with at least one pressure roll (3, 3'), wherein the retaining means (70) of the chocks of at least one of the rolls are adjusted so as to determine a crossing of a plane passing through the axes of one work roll (2) and the corresponding pressure roll(s) with respect to a plane passing through the axes of the other work roll (2') and the corresponding pressure roll(s) (3').

21. The method according to claim 16, in a rolling mill comprising two work rolls (2, 2') each associated with at least one pressure roll (3, 3'), wherein the retaining means (70) of the chocks of at least one of the rolls are adjusted so as to determine a crossing of the clamping plane passing through the axes of the two work rolls (2, 2') with respect to the plane passing through the axes of the pressure rolls (3, 3').

* * * * *